US007275942B1

(12) United States Patent
Wu

(10) Patent No.: US 7,275,942 B1
(45) Date of Patent: Oct. 2, 2007

(54) ROTARY-TYPE SAFETY SOCKET

(75) Inventor: Meng-Hsiu Wu, Taoyuan Hsien (TW)

(73) Assignee: Exito Electronics Co., Ltd., Taoyuan Hsien (TW)

( * ) Notice: Subject to any disclaimer, the term of this patent is extended or adjusted under 35 U.S.C. 154(b) by 0 days.

(21) Appl. No.: 11/635,596

(22) Filed: Dec. 8, 2006

(51) Int. Cl.
*H01R 13/44* (2006.01)

(52) U.S. Cl. ..... 439/145; 174/67

(58) Field of Classification Search ..... 439/138, 439/139, 142, 143, 145; 174/67
See application file for complete search history.

(56) References Cited

U.S. PATENT DOCUMENTS 2,752,581 A * 6/1956 Benander ..... 439/139
5,865,633 A * 2/1999 Hou ..... 439/139
5,866,846 A * 2/1999 Huag ..... 174/67
5,902,140 A * 5/1999 Cheung et al. ..... 439/139
6,984,139 B1 * 1/2006 Lai ..... 439/142

* cited by examiner

*Primary Examiner*—James R. Harvey
(74) *Attorney, Agent, or Firm*—Troxell Law Office, PLLC

(57) ABSTRACT

A rotary-type safety socket of the present invention comprises a socket body, at least a holey base, and at least a top cover. The socket body comprises an insulator and at least an elastic device. The insulator has a recessed slideway on the top surface. The holey base is held in the socket body. The holey base has a top plate and a tube body. The top plate has several through holes and an axial hole. The tube body is extended from the outer edge of the axial hole. The top cover is movably sleeved onto the holey base. The top cover comprises a plate body, several through holes on the plate body, a pillar extending from one surface of the plate body, a protrudent part extending from one surface of the plate body, and a second positioning ear extending from the outer edge of the plate body.

5 Claims, 6 Drawing Sheets

ROTARY-TYPE SAFETY SOCKET

FIELD OF THE INVENTION

The present invention relates to a rotary-type safety socket, and more particularly to a rotary-type safety socket capable of misaligning the top cover with the holey base.

BACKGROUND OF THE INVENTION

The electronic products have developed rapidly over the past few decades. With more power sockets utilized than before, the safety structure is apparently important for the power socket.

Generally speaking, the conventional socket has no safeguard structure formed thereon. As a result, the fire accident, which is caused by accidental discharge, is usually created after insertion of foreign matter into the socket. In addition, the children may get an electric shock after inserting the conducting matter into the socket. Accordingly, there is a need to improve the conventional socket.

Moreover, a cover is presently disclosed for insertion into the top surface of the socket directly, wherein the cover can cover the insertion holes to avoid the occurrence of accident. However, the cover is not easy to use. When the socket is in use, the cover must be stored additionally. When the socket is not in use, the cover must be re-inserted into the top surface of the socket. However, it is very easy to mislay the cover when the socket is in use, and it is very complicated to attach or detach the cover, causing the inconvenience to the user.

SUMMARY OF THE INVENTION

In view of foregoing conventional drawbacks, a major object of the present invention is to provide a safe, hard-to-lose, and easy-to use rotary-type safety socket.

In order to achieve the aforesaid object, a rotary-type safety socket of the present invention is comprised of a socket body, at least a holey base, and at least a top cover. The socket body comprises an insulator and at least an elastic device. The insulator has a recessed slideway on the top surface. The holey base is held in the socket body. The holey base has a top plate and a tube body. The top plate has several through holes and an axial hole formed thereon. The tube body is extended from the outer edge of the axial hole. The top cover is movably sleeved onto the holey base. The top cover comprises a plate body, several through holes on the plate body, a pillar extending from one surface of the plate body for insertion into the aforesaid axial hole, a protrudent part extending from one surface of the plate body for being slidably sleeved into the aforesaid slideway, and a second positioning ear extending from the outer edge of the plate body.

The rotary-type safety socket is safe, hard-to-lose, and easy-to use by misaligning the top cover with the holey base.

DETAILED DESCRIPTION OF THE PREFERRED EMBODIMENT

Figure 1:
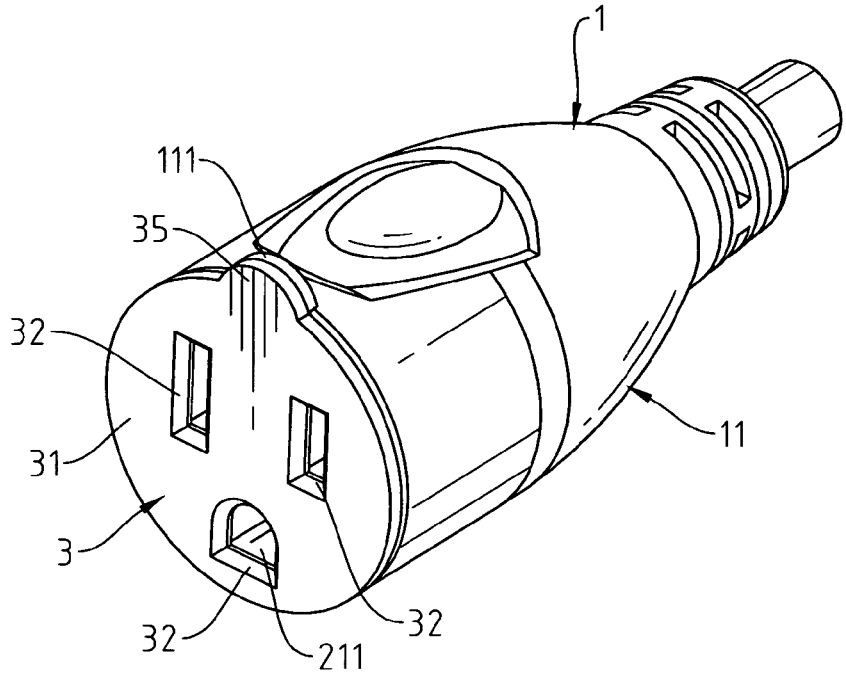
FIG. 1 is an elevational view showing a preferred embodiment of the present invention.
Figure 2:
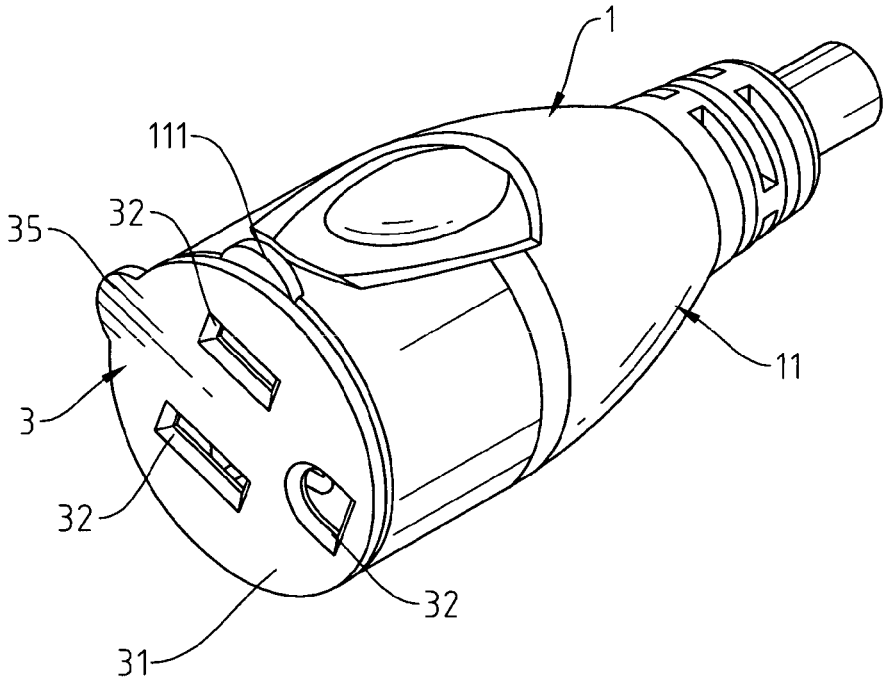
FIG. 2 is an elevational diagram of the present invention taken from another angle.
Figure 4:
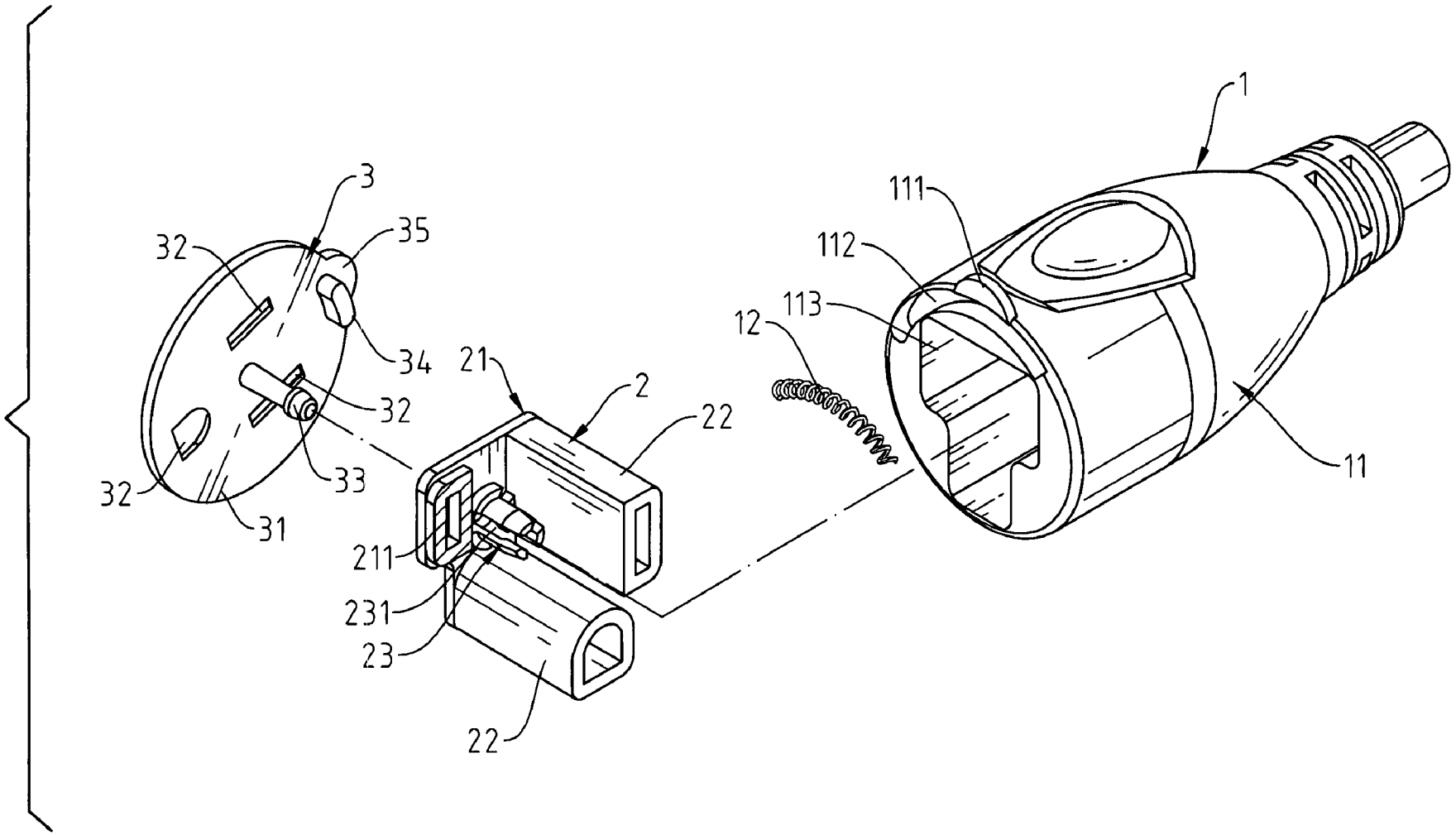
FIG. 4 is an elevational, decomposed diagram of the present invention.
Figure 5:
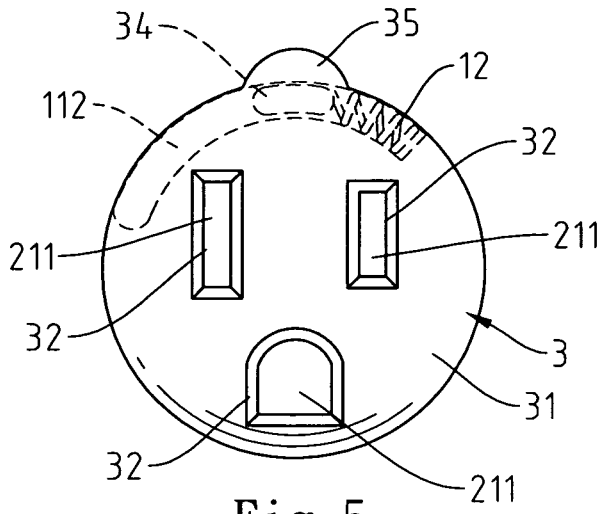
FIG. 5 is a schematic view showing the step for rotating the top cover of the present invention.

Referring to FIG. 1, FIG. 2, and FIG. 4, a rotary-type safety socket of the present invention comprises a socket body 1, at least a holey base 2, and at least a top cover 3.

Figure 6:
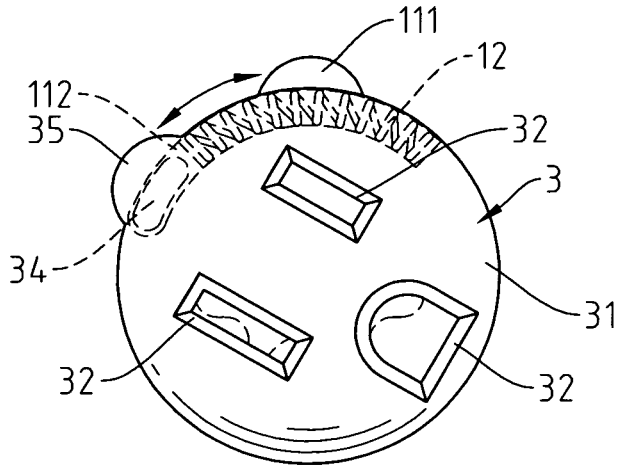
FIG. 6 is a schematic view showing another step for rotating the top cover of the present invention.

The socket body 1 comprises an insulator 11 and at least an elastic device 12, wherein the insulator 11 has an outward extended first positioning ear 111 on the top edge, and the insulator 11 has a recessed slideway 112 on the top surface for holding the elastic device 12. The elastic device 12 is a compressible spring (shown in FIG. 6) or an extensible spring (shown in FIG. 7). In addition, the insulator 11 has an upward-opening chamber 113 formed therein.

The holey base 2 is held in the chamber 113 of the socket body 1. The holey base 2 comprises a top plate 21, several reception tunnels 22, and a tube body 23. The top plate 21 has several through holes 211 and an axial hole 212 formed thereon. The tube body 23 has several gaps 231. In addition, these reception tunnels 22 are extended from the outer edges of the through holes 211. The tube body 23 is extended from the outer edge of the axial hole 212.

The top cover 3 is movably sleeved onto the top surface of the holey base 2. The top cover 3 comprises a plate body 31, several through holes 32 on the plate body 31 corresponding to the aforesaid through holes 211, a pillar 33 extending from one surface of the plate body 31 for insertion into the aforesaid axial hole 212, a protrudent part 34 extending from one surface of the plate body 31 for being slidably sleeved into the aforesaid slideway 112, and a second positioning ear 35 extending from the outer edge of the plate body 31.

Figure 3:
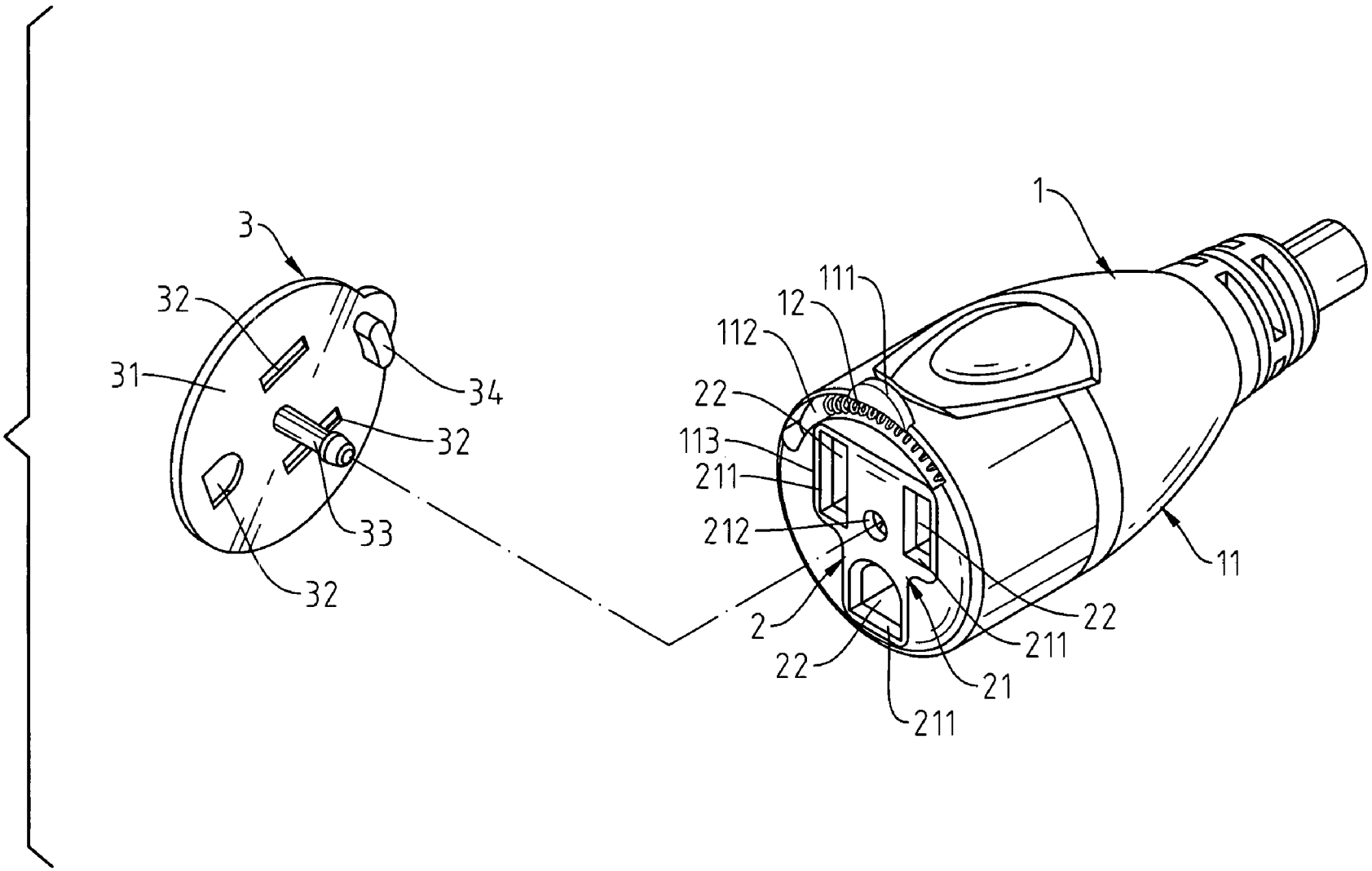
FIG. 3 is an elevational, decomposed view showing the top cover and other elements of the present invention.

As shown in FIG. 3 and FIG. 4, the aforesaid elements are assembled to one another. In accordance with the rotary-type safety socket of the present invention, the holey base 2 is inserted into the chamber 113 of the socket body 1. The pillar 33 of the top cover 3 is sleeved into the axial hole 212 of the holey base 2, and movably, rotatably sleeved into the tube body 23. In addition, the protrudent part 34 of the top cover 3 is sleeved into the slideway 112 so that the protrudent part 34 can be compressed by the elastic device 12 to allow the top cover 3 to be rotated by an angle for thereby misaligning the through holes 32 of the top cover 3 with the through holes 211 of the holey base 2.

Figure 7:
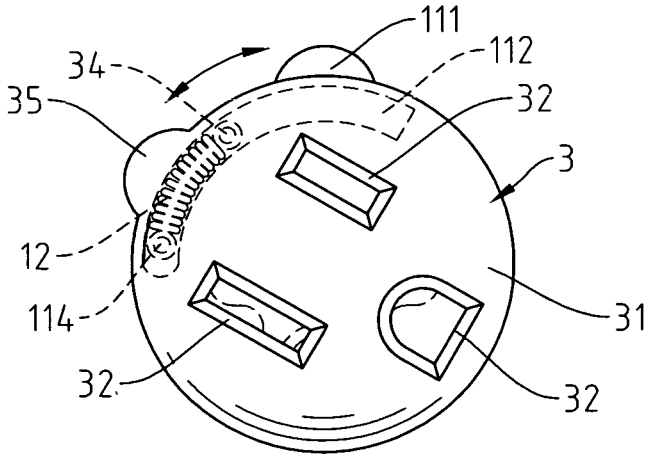
FIG. 7 is a schematic view showing the step for displacing the elastic device of the present invention.
Figure 8:
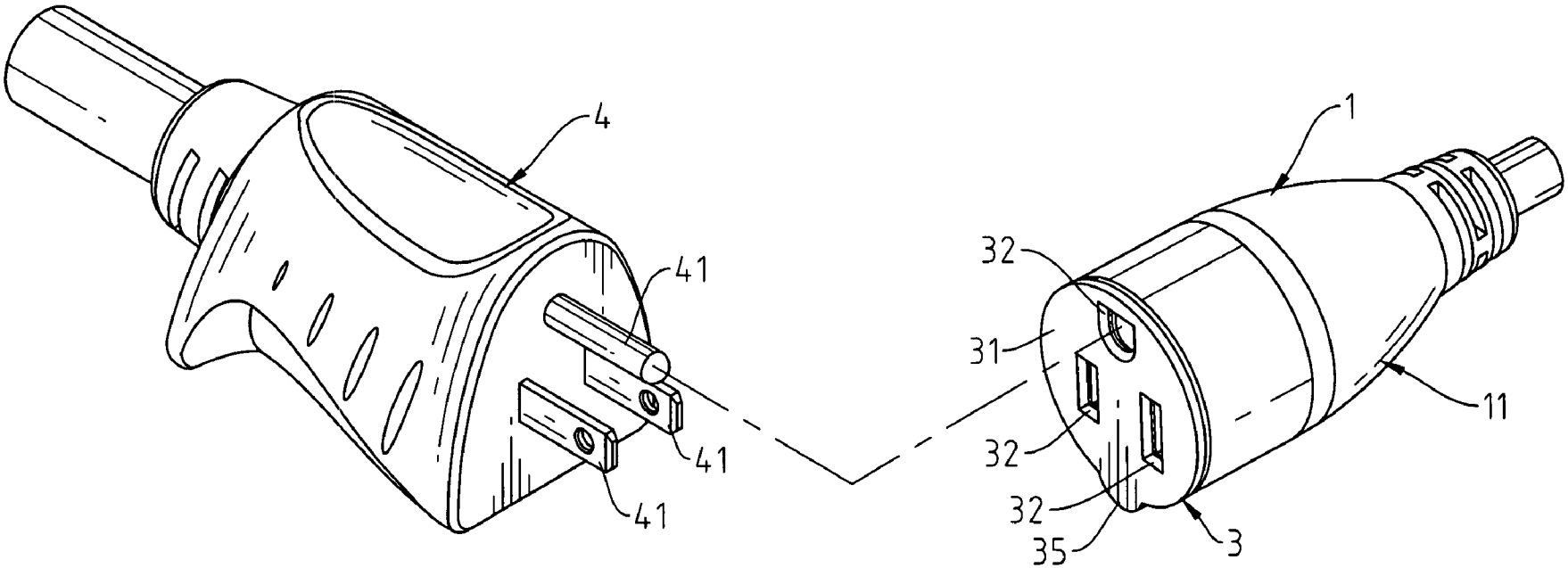
FIG. 8 is a schematic view showing the step for coupling the plug with the rotary-type safety socket of the present invention.

Referring to FIG. 5 through FIG. 8, the usage statuses of the aforesaid elements are shown. The rotary-type safety socket of the present invention is for coupling with a plug 4. The plug 4 comprises several terminals 41 for insertion into the through holes 211, the reception tunnels 22, and the through holes 32 correspondingly. When in use, the top cover 3 can be rotated by shifting the first positioning ear 111 and the second positioning ear 35 to allow the through holes 32 to overlap the through holes 211 so that the terminals 41 of the plug 4 can be inserted into the rotary-type safety socket of the present invention. After detaching the terminals 41 of the plug 4 from the rotary-type safety socket, the protrudent part 34, which is resiliently pushed by the elastic device 12, can be thus shifted and positioned to allow the through holes 32 of the top cover 3 to misalign with the through holes 211 of the holey base 2 automatically. Referring to FIG. 7, the insulator 11 of the socket body 1 has an additional pillar 114 embedded immovably in the slideway 112, and the elastic device 12 of the socket body 1 is an extensible spring, wherein one end of the elastic device 12 is fixed on the pillar 114, and the other end of the elastic device 12 is fixed on the protrudent part 34 so as to achieve the same purposes and effects as the aforesaid preferred embodiment.

Figure 9:
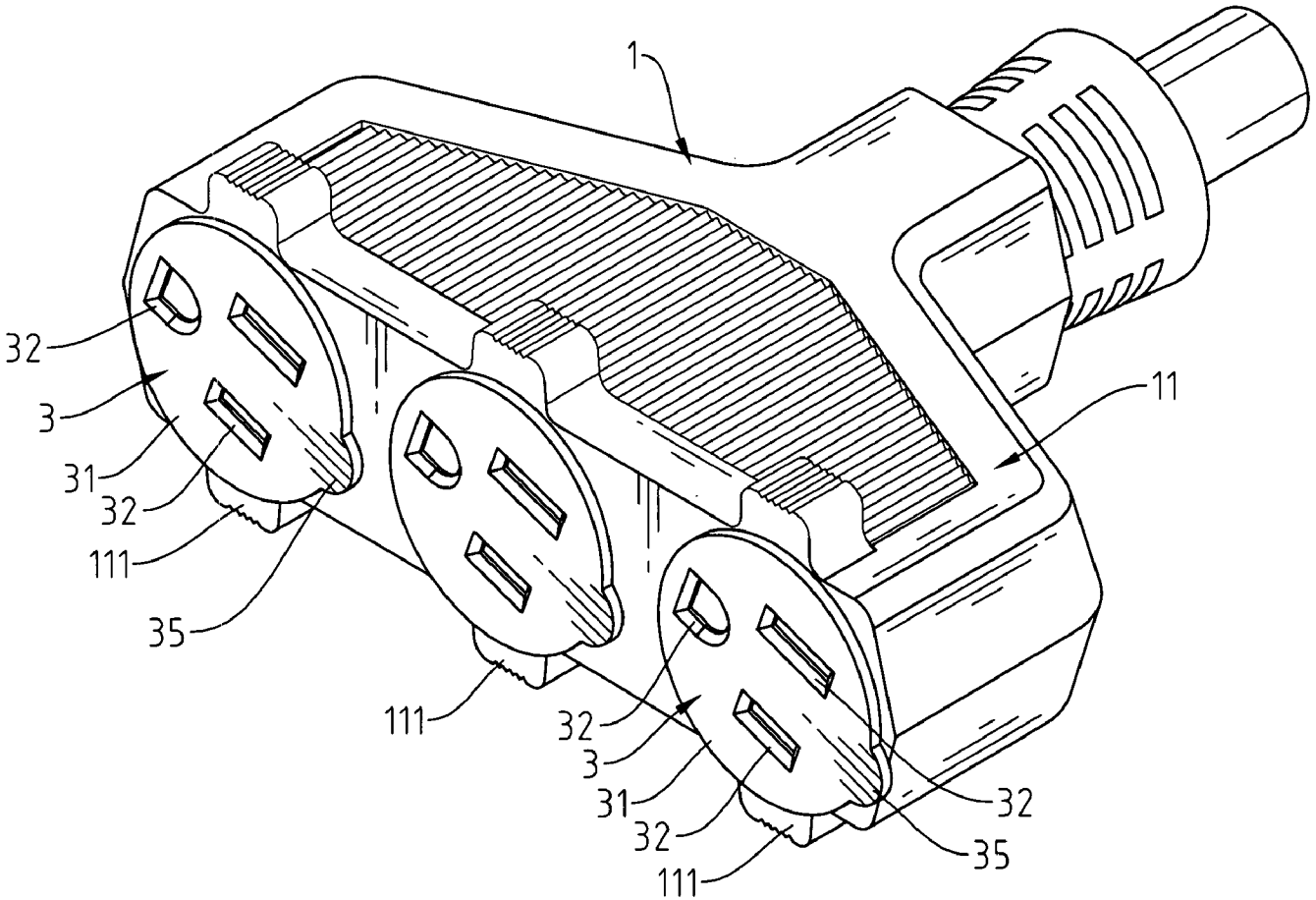
FIG. 9 is an elevational view showing another preferred embodiment of the present invention.

It is additionally noted that in the aforesaid preferred embodiment, the socket body 1 is assembled to the holey base 2 and the top cover 3. Of course, the socket body 1 has several chambers 113 inside which the respective holey bases 2 and the respective top covers 3 are mounted, as shown in FIG. 9, for holding several plugs 4 (shown in FIG. 8) simultaneously.

What the invention claimed is:

1. A rotary-type safety socket comprising:

a socket body comprising at least an elastic device and an insulator having a recessed slideway on a top surface thereof for holding said elastic device;

at least a holey base for insertion into said socket body, said holey base comprising a top plate having a plurality of through holes and an axial hole and a tube body extending from an outer edge of said axial hole; and at least a top cover movably sleeved onto a top surface of said holey base, said top cover comprising a plate body, a plurality of through holes on said plate body corresponding to said through holes of said holey base, a pillar extending from a surface of said plate body for insertion into said axial hole of said holey base, and a protrudent part extending from said surface of said plate body for being slidably sleeved into said slideway.

2. A rotary-type safety socket of claim 1, wherein said insulator has an outward extended first positioning ear on a top edge thereof.

3. A rotary-type safety socket of claim 1, wherein said top cover has a second positioning ear extending from an outer edge of said plate body.

4. A rotary-type safety socket of claim 1, wherein said elastic device is a compressible spring.

5. A rotary-type safety socket of claim 1, wherein said elastic device is an extensible spring.

* * * * *